US008953954B2

(12) United States Patent
Sawada

(10) Patent No.: US 8,953,954 B2
(45) Date of Patent: Feb. 10, 2015

(54) MONITORING DEVICE SYSTEM, IMAGE FORMING APPARATUS, AND MONITORING DEVICE METHOD

(75) Inventor: Masaichi Sawada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 325 days.

(21) Appl. No.: 12/985,851

(22) Filed: Jan. 6, 2011

(65) Prior Publication Data

US 2011/0164886 A1 Jul. 7, 2011

(30) Foreign Application Priority Data

Jan. 6, 2010 (JP) ..... 2010-001467

(51) Int. Cl.
*G03G 15/00* (2006.01)

(52) U.S. Cl.
CPC ..... *G03G 15/55* (2013.01); *G03G 15/5075* (2013.01); *G03G 2215/00109* (2013.01)
USPC ..... 399/8; 399/10

(58) Field of Classification Search
USPC ..... 399/8, 10–11
See application file for complete search history.

(56) References Cited

U.S. PATENT DOCUMENTS

| | | | | |
|---|---|---|---|---|
| 5,434,650 | A * | 7/1995 | Nakahara et al. | 399/8 |
| 5,682,140 | A * | 10/1997 | Christensen et al. | 340/540 |
| 7,061,391 | B2 * | 6/2006 | Hopper et al. | 340/691.1 |
| 8,310,708 | B2 * | 11/2012 | Murakami | 358/1.15 |
| 2003/0028753 | A1 * | 2/2003 | Ohishi | 712/205 |
| 2004/0236862 | A1 | 11/2004 | Ito et al. | |
| 2005/0254086 | A1 * | 11/2005 | Shouno | 358/1.15 |
| 2005/0281566 | A1 * | 12/2005 | Kaneko | 399/8 |
| 2006/0077433 | A1 * | 4/2006 | Zhang et al. | 358/1.15 |
| 2008/0219681 | A1 * | 9/2008 | Kim | 399/8 |
| 2009/0077216 | A1 | 3/2009 | Rhodes et al. | |
| 2010/0079803 | A1 * | 4/2010 | Takeya | 358/1.15 |
| 2010/0165388 | A1 | 7/2010 | Ikeura | |

FOREIGN PATENT DOCUMENTS

| | | |
|---|---|---|
| JP | 06-169366 | 6/1994 |
| JP | 08-195849 | 7/1996 |
| JP | 09-321931 | 12/1997 |

* cited by examiner

*Primary Examiner* — Clayton E Laballe
*Assistant Examiner* — Leon W Rhodes, Jr.
(74) *Attorney, Agent, or Firm* — Oblon, Spivak, McClelland, Maier & Neustadt, L.L.P.

(57) ABSTRACT

A monitoring device system that includes a user apparatus, including a monitoring device application, and an image forming apparatus. The user apparatus includes an application information sending unit configured to send application information corresponding to the monitoring device application to the image forming apparatus, and a notice information control unit configured to acquire information about the image forming apparatus. The image forming apparatus includes a display unit configured to display an application information item corresponding to the received application information from the user apparatus, and a communication control unit configured to send the information about the image forming apparatus to the user apparatus in response to a user selecting the displayed application information item at the image forming apparatus.

7 Claims, 9 Drawing Sheets

| | |
|---|---|
| WIDGET ID | monitor001 |
| USER ID | USER A |
| COORDINATION FUNCTION IDENTIFIER | print |
| WIDGET ADDRESS | http://xxx/xxx/xxx |
| DISPLAY NAME | MONITOR DEVICE |
| ⋮ | ⋮ |

126

| USER ID | WIDGET INFORMATION ACQUIRING URL |
|---|---|
| USER A | http://xxxxxxx |
| USER B | ... |
| | |

FIG. 9
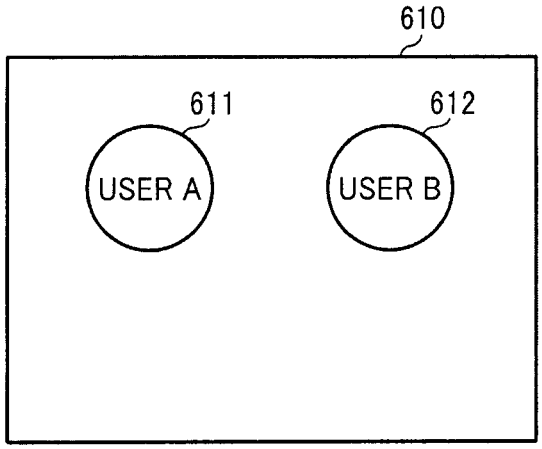
FIG. 10
| | |
|---|---|
| WIDGET ID | monitor001 |
| USER ID | USER A |
| COORDINATION FUNCTION IDENTIFIER | print |
| WIDGET ADDRESS | http://xxx/xxx/xxx |
| DISPLAY NAME | MONITOR DEVICE |
| WIDGET RELAY URL | http://yyy/yyy/yyy |
| ⋮ | ⋮ |
FIG. 11
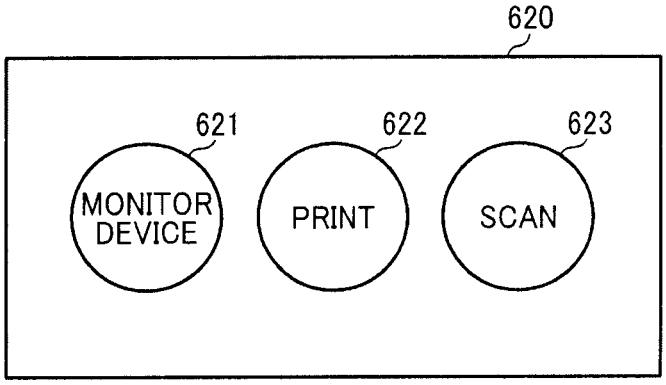

MONITORING DEVICE SYSTEM, IMAGE FORMING APPARATUS, AND MONITORING DEVICE METHOD

CROSS REFERENCE TO RELATED APPLICATIONS

This application claims the benefit of priority under 35 USC §119 from Japanese Patent Application No. 2010-001467, filed Jan. 6, 2010, the entire contents of which are incorporated herein by reference.

BACKGROUND OF THE INVENTION

1. Field of the Invention

The present invention relates to a monitoring device system, an image forming apparatus, and a monitoring device method.

2. Description of the Related Art

It can be difficult to fix paper jams with image forming apparatuses such as printers, copiers, fax machines, and Multi Function Peripherals (hereinafter, "apparatuses"). Therefore, the apparatus is constructed such that the user of the apparatus can fix the problem to the best extent possible.

However, there are some problems that only a trained service person can solve. In addition, the apparatuses need maintenance to prevent future problems or to provide stable operation. For example, the apparatuses have several parts to transport paper when forming an image, such as rollers. Some of the parts are expendable and will degrade after a period of time. These parts need to be changed at the right time (for example, depending on a number of pages) by the trained service person to work stably.

Therefore users may make a maintenance contract with the manufacturer or the distributor of the apparatuses. The contract may allow for serviced maintenance in the following categories.

(1) Change expendable supplies to prevent trouble depending on printed pages or time of use.

(2) Regular sweeping and adjusting to provide stable operation without changes (3) Repairing claimed problems that cannot be solved by the user of the apparatus.

(4) Others like teaching how to use.

Presently, monitoring device systems are constructed to monitor devices remotely via a network (hereinafter, "remote management system") to improve the efficiency of maintenance and to ensure that the apparatuses are in good condition at all times. Detecting an abnormal status or a pre-abnormal status, the remote management systems automatically report information about the apparatus status to servers. A call center operative or a trained service person may provide maintenance depending on the reported information.

It is possible to reduce claimed problems by a user with the use of the remote management systems. But due to anxiety over security concerns, some users may reject installing the remote management system even if the remote management system has security.

BRIEF SUMMARY

According to an embodiment, there is provided a monitoring device system comprising: a user apparatus, including a monitoring device application; and an image forming apparatus, wherein the user apparatus includes an application information sending unit configured to send application information corresponding to the monitoring device application to the image forming apparatus, and a notice information control unit configured to acquire information about the image forming apparatus, wherein the image forming apparatus includes a display unit configured to display an application information item corresponding to the received application information from the user apparatus, and a communication control unit configured to send the information about the image forming apparatus to the user apparatus in response to a user selecting the displayed application information item at the image forming apparatus.

According to another embodiment, there is provided an image forming apparatus configured to connect to a user apparatus that includes a monitoring device application via a network, comprising: a communication control unit configured to receive application information corresponding to the monitoring device application from the user apparatus; a display unit configured to display an application information item corresponding to the received application information from the user apparatus, and wherein the communication control unit is configured to send information about the image forming apparatus to the user apparatus in response to a user selecting the displayed application information item at the image forming apparatus.

According to another embodiment, there is provided a monitoring method, implemented on a monitoring device system that comprises a user apparatus including a monitoring device application and an image forming apparatus, the method comprising: at the user apparatus, sending application information corresponding to the monitoring device application to the image forming apparatus; at the image forming apparatus, displaying an application information item corresponding to the monitoring device application based on the received application information from the user apparatus; at the image forming apparatus, sending detail information about the image forming apparatus to the user apparatus in response to a user selecting the displayed application information item at the image forming apparatus; and at the user apparatus, acquiring the detail information about the image forming apparatus from the image forming apparatus.

BRIEF DESCRIPTION OF THE DRAWINGS

Other objects, features and advantages of the present embodiments will become more apparent from the following detailed description when read in conjunction with the accompanying drawings, in which:

FIG. 9 illustrates an example of a displayed user selection screen page;

FIG. 10 illustrates a configuration of the widget information of the monitoring devices widget 21 sent from the widget management server 30 to the image forming apparatus 10;

FIG. 11 illustrates an example of a displayed widget selection screen page;

DETAILED DESCRIPTION

A description is given, with reference to the accompanying drawings, of embodiments of the present invention.

Figure 1:
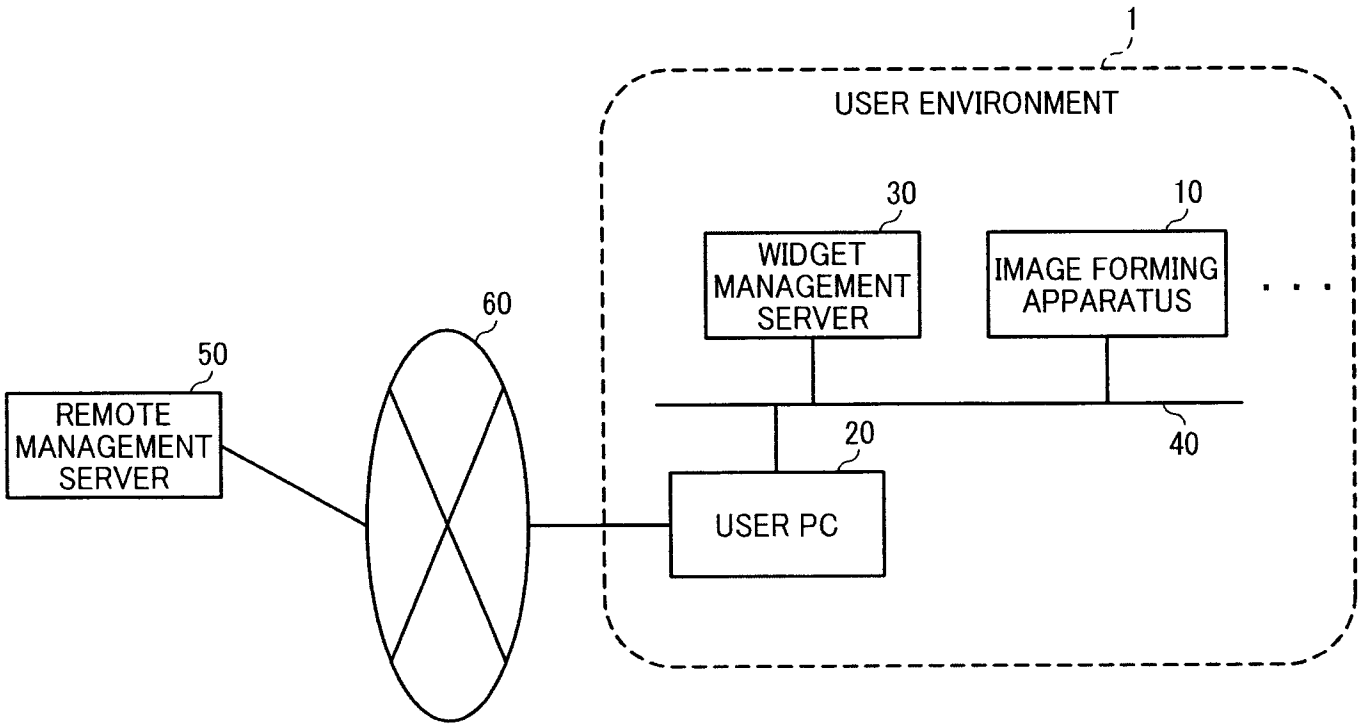
FIG. 1 illustrates a configuration of a monitoring device system according to an embodiment.

FIG. 1 illustrates a configuration of a monitoring device system according to an embodiment of the present invention. A user environment 1 shown in FIG. 1 connects a remote management server 50 via a global network 60 such as the internet.

The remote management server 50 is a computer which is constructed to monitor an image forming apparatus 10 via the global network 60 remotely.

The user environment 1 shown in FIG. 1 is a computer system installed at the location of the image forming apparatus 10, such as a user's office. The user environment 1 includes at least one image forming apparatus 10, at least one user PC 20, and a widget management server 30, which are connected to each other by a network 40 (wired or wireless) such as a LAN (Local Area Network).

The image forming apparatus 10 is a multifunction peripheral that can implement plural functions such as printing, scanning, copying, and transmitting/receiving information by fax communications, in a single casing. However, in another example, the image forming apparatus 10 may be a device without a scanning function such as a printer. The image forming apparatus 10 is a monitored target device. It is impossible to access the image forming apparatus 10 via the network 60. In other words, the image forming apparatus 10 is not accessed from outside the user environment 1 so that it is hidden in the user environment 1.

Any one of the user PCs 20 is an example of a monitoring device apparatus located in user environment 1. The user PC 20 is installed with functions such as monitoring the image forming apparatus 10. As necessary, the user PC 20 sends information monitored from the image forming apparatus 10 to remote management server 50. The preferred user PC 20 may also be owned by an authorized user like an administrator of the image forming apparatus 10.

The widget management server 30 mediates between an echo of the user PCs 20 and the image forming apparatus 10 to execute a program called a "widget" as will hereinafter be described in detail.

Figure 2:
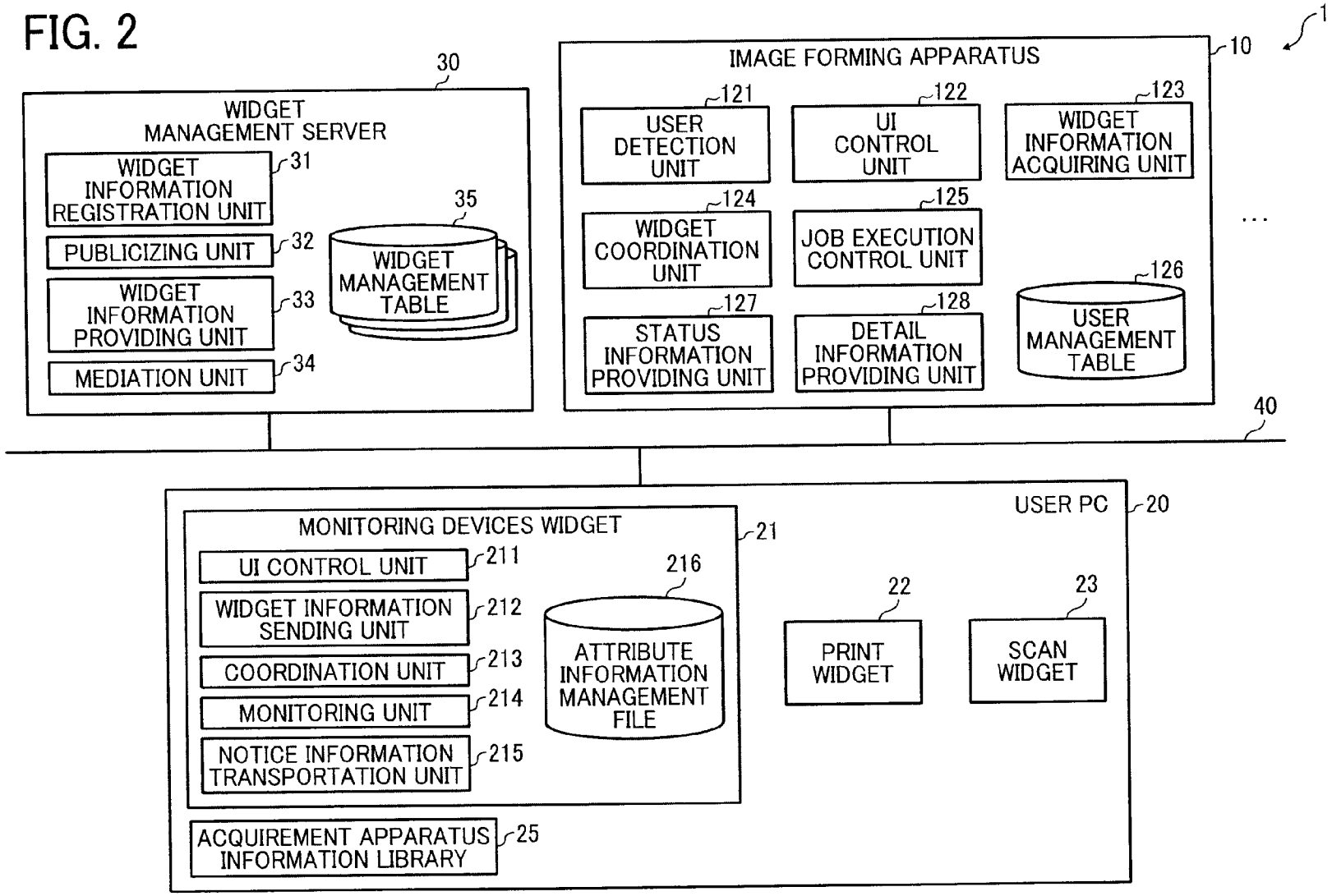
FIG. 2 illustrates a configuration of function structures of the equipment in the user environment 1.

FIG. 2 illustrates a functional configuration of the structures in the user environment 1.

A user PC 20 shown in FIG. 2 includes a monitoring devices widget 21, a print widget 22, a scan widget 23 and an acquirement apparatus information library 25.

The monitoring devices widget 21, the print widget 22 and the scan widget 23 are application programs called "widgets" in the embodiment. Each of the widgets constructs an individual implementation. A common function of widgets is to provide predetermined services in coordination with the image forming apparatus 10.

The monitoring devices widget 21 is a widget which acquires status information or usage statistical information of the image forming apparatus 10. The monitoring devices widget 21 sends the acquired information of the image forming apparatus 10. The monitoring devices widget 21 includes a UI control unit 211, a widget information sending unit 212, a coordination unit 213, a monitoring unit 214, notice information transportation unit 215 and an attribute information management file 216.

The UI control unit 211 displays various display screen pages regarding the monitoring devices widget 21 on a display device of the user PC 20. In response to activating the monitoring devices widget 21, the widget information sending unit 212 sends a request to register widget information regarding the monitoring devices widget 21 to the widget management server 30. The widget information includes an identifier (widget ID) of the monitoring devices widget 21. The widget information includes an identifier of the user PC 20, because identifying the widget corresponds to identifying the user PC 20

The coordination unit 213 controls communications (exchange of information, etc.) for coordinating with the image forming apparatus 10. The monitoring unit 214 periodically acquires the status information of the image forming apparatus 10. In response to input from a user, a notice information transportation unit 215 acquires detail information such as the status information, the usage statistical information and various log information of the targeted image forming apparatus 10, and transports notice information corresponding to the acquired detail information to the remote management server 50. However the notice information transports to destinations authorized by user. If transporting the notice information is prohibited, the notice information is not transported. Even if transporting the notice information is allowed, the notice information can be restricted so that only a part of the detail information is transported.

The attribute information management file 216 is for storing attribute information of the monitoring devices widget 21. The attribute information includes in advance, for example, an identifier (widget ID) of the monitoring devices widget 21, a user ID of the user who owns the monitoring devices widget 21, a list of the targeted image forming apparatuses 10, a communication identifier of the monitoring devices widget 21, and the part of the detail information including the notice information.

The print widget 22 is a widget that causes the image forming apparatus 10 to execute a print job via the network 40.

The scan widget 23 is a widget for executing a predetermined process (for example, distributing or saving) on image data obtained by a scanning process of the image forming apparatus 10.

The acquirement apparatus information library 25 is a library (for example, DLL (Dynamic Link Library)) that configures an API (Application Program Interface) for acquiring the detail information from the image forming apparatus 10. The monitoring unit 214 and notice information transportation unit 215 acquire the status information or the detail information of the image forming apparatus 10 using the acquirement apparatus information library 25. The acquirement apparatus information library 25 is constructed to allow shared use so that other monitoring applications can share the acquirement apparatus information library 25.

The attribute information management file 216 of the monitoring devices widget 21 stores user IDs of owners of respective widgets, which means that the widgets belong to corresponding users. Thus, widgets of a same type may be distinguished as different widgets if the widgets belong to different users. For example, when a widget belongs to user A, basically only user A is allowed to use this widget. When a widget belongs to user B, basically only user B is allowed to use this widget. However, when a usage right is given to another user by an access control function, the other user will be allowed to use a widget owned by someone else.

The widget management server 30 is a computer including a widget information registration unit 31, a publicizing unit 32, a widget information providing unit 33, and a mediation unit 34. A CPU in the widget management server 30 executes programs installed in the widget management server 30 to implement each of the units.

The widget information registration unit 31 receives, from the user PC 20, a request to register application information, and saves the widget information in a widget information management table 35. The widget information management table 35 is generated in a storage device of the network widget management server 30 for each user. That is to say, each widget information management table 35 manages widget information of a widget belonging to one of the users. The publicizing unit 32 publicizes (broadcasts or multicasts), on the network 40, a user ID included in the widget information received by the widget information registration unit 31. The publication is issued for each user (for each user ID). For example, when a user ID of user A has already been publicized, and then widget information belonging to user A is newly received, the publicizing unit 32 will not issue a publication corresponding to the new widget information. That is to say, the information publicized by the publicizing unit 32 is used for sending a notification to the image forming apparatus 10 that there is a new user who is allowed to use a certain widget. However, in another example, the publication may be issued for each widget information item. In this case, plural publications will be issued for the same user, but redundant information may be deleted at the image forming apparatus 10. The widget information providing unit 33 provides (sends) widget information registered in the widget information management table 35 to the image forming apparatus 10, in response to a request from the image forming apparatus 10. The mediation unit 34 mediates communications between a widget and the image forming apparatus 10.

Any one of the user PCs 20 may also serve as the widget management server 30. That is to say, any one of the user PCs 20 may include the widget information registration unit 31, the publicizing unit 32, the widget information providing unit 33, and the mediation unit 34.

The image forming apparatus 10 includes a user detection unit 121, a UI control unit 122, a widget information acquiring unit 123, a widget coordination unit 124, a job execution control unit 125, a user management table 126, a status information providing unit 127 and a detail information providing unit 128. A CPU in the image forming apparatus 10 executes programs installed in the image forming apparatus 10 to implement each of the units.

The user detection unit 121 detects the presence of a user who is allowed to use a widget based on a publication issued by the widget management server 30, and registers a user ID included in the publication in the user management table 126. The user management table 126 is for managing a list of users that execute widgets in the network 40. The UI control unit 122 receives, from a user, input of an operation instruction for a widget. The widget is located in the user PC 20, but the widget may be operated from the operations panel of the image forming apparatus 10. The widget information acquiring unit 123 acquires, from the widget management server 30, widget information of a widget belonging to a user selected from among the users registered in the user management table 126. The widget coordination unit 124 controls communications between the image forming apparatus 10 and the widget. The job execution control unit 125 controls execution of a function requested by the widget. For example, the job execution control unit 125 controls execution of a printing operation or a scanning operation. The status information providing unit 127 and the detail information providing unit 128 are server functions corresponding to the acquirement apparatus information library 25. For example, the status information providing unit 127 handles a request to acquire state information of image forming apparatus 10 from the acquirement apparatus information library 25. The detail information providing unit 128 handles a request to acquire detail information of image forming apparatus 10 from the acquirement apparatus information library 25.

Figure 3:
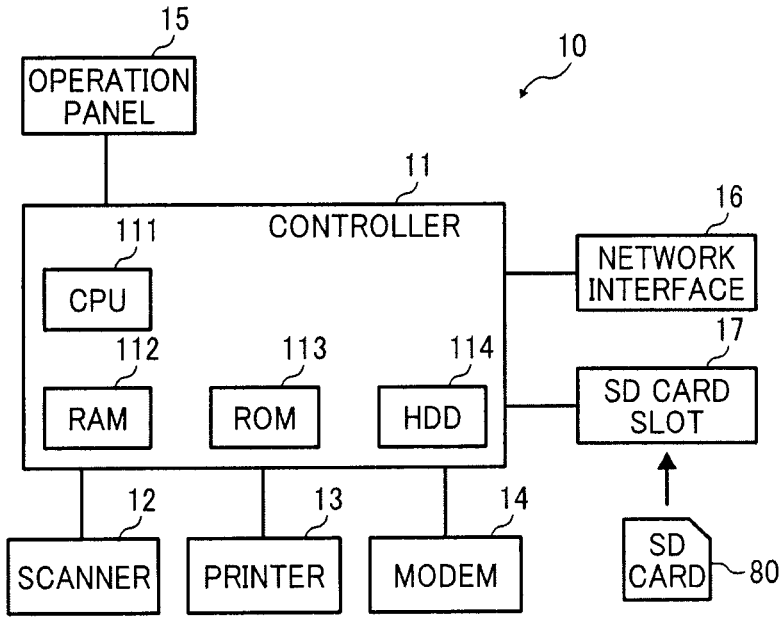
FIG. 3 illustrates a hardware configuration of the image forming apparatus 10 according to an embodiment.

Next, a description is given of a hardware configuration of the devices. FIG. 3 illustrates a hardware configuration of the image forming apparatus 10 according to an embodiment. As shown in FIG. 3, the image forming apparatus 10 includes hardware elements such as a controller 11, a scanner 12, a printer 13, a modem 14, an operations panel 15, a network interface 16, and an SD card slot 17.

The controller 11 includes a CPU 111, a RAM 112, a ROM 113, and an HDD 114. The ROM 113 stores various programs and data used by the programs. The RAM 112 is used as a storage area for loading programs and a work area of the loaded programs. The CPU 111 executes the program loaded in the RAM 112 to implement various functions. The HDD 114 stores various programs and data used by the programs.

The scanner 12 is a hardware element for scanning an original document to obtain image data. The printer 13 is a hardware element for printing the image data onto a sheet. The modem 14 is a hardware element for connecting the image forming apparatus 10 to a telephone line, and for executing transmission/reception of image data by fax communications. The operations panel 15 is a hardware element including an input unit such as buttons for receiving inputs from a user, and a display unit such as a liquid crystal panel. The network interface 16 is a hardware element for connecting the image forming apparatus 10 to a network (wired or wireless) such as a LAN (Local Area Network). The SD card slot 17 is used for reading a program recorded in an SD card 80. That is to say, the image forming apparatus 10 may not only execute the program recorded in the ROM 113, but may also load the program recorded in the SD card 80 into the RAM 112, and execute the program loaded in the RAM 112.

Figure 4:
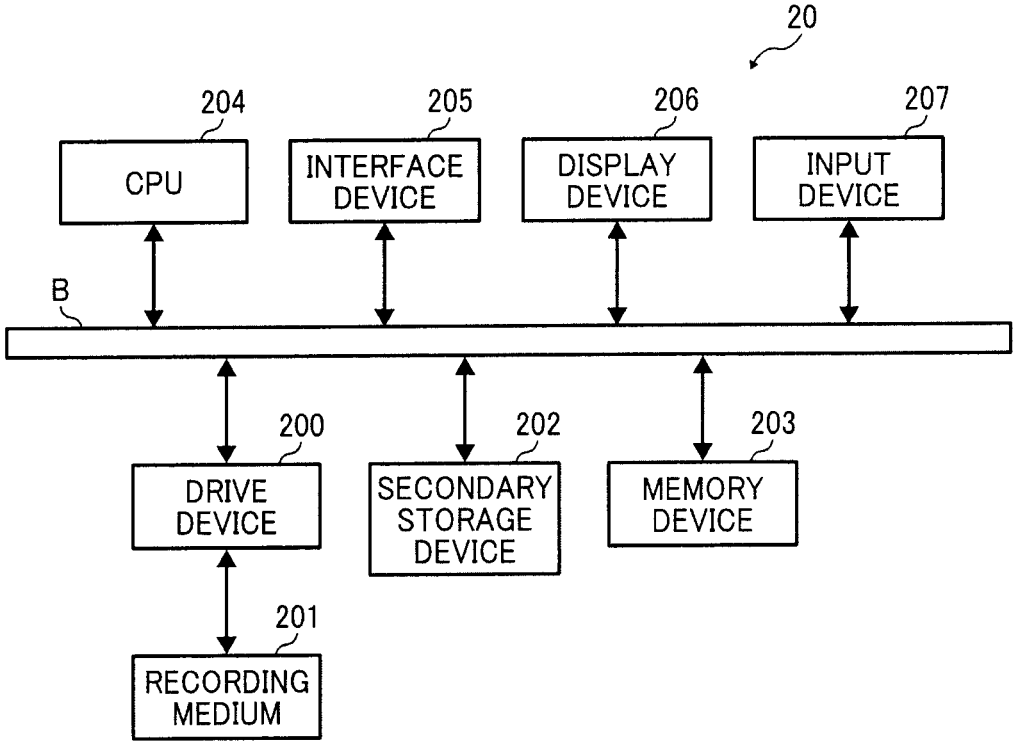
FIG. 4 illustrates a hardware configuration of the user PC 20 according to an embodiment.

FIG. 4 illustrates a hardware configuration of the user PC 20 according to an embodiment. The user PC 20 illustrated in FIG. 4 includes a drive device 200, a secondary storage device 202, a memory device 203, a CPU 204, an interface device 205, a display device 206, and an input device 207, which are interconnected via a bus B.

A program that implements a process of the user PC 20 is provided in a recording medium 201 such as a CD-ROM. When the recording medium 201 storing the program is set in the drive device 200, the program is installed from the recording medium 201 into the secondary storage device 202 via the drive device 200. However, the program need not be installed from the recording medium 201; the program may be downloaded from another computer via a network. The secondary storage device 202 stores the installed program, together with necessary files and data.

The memory device 203 reads the program from the secondary storage device 202 and stores the program, when an instruction to activate the program has been given. The CPU 204 implements the functions pertaining to the user PC 20 in accordance with the program stored in the memory device 203. The interface device 205 is used as an interface for connecting the user PC 20 to a network. The display device 206 displays a GUI (Graphical User Interface) by a program. The input device 207 may include a keyboard and a mouse, which is used for inputting various operation instructions. A description is given below of a process executed in device monitoring system. First, the widget management server 30 registers the widget information of monitoring devices widget 21.

Figure 5:
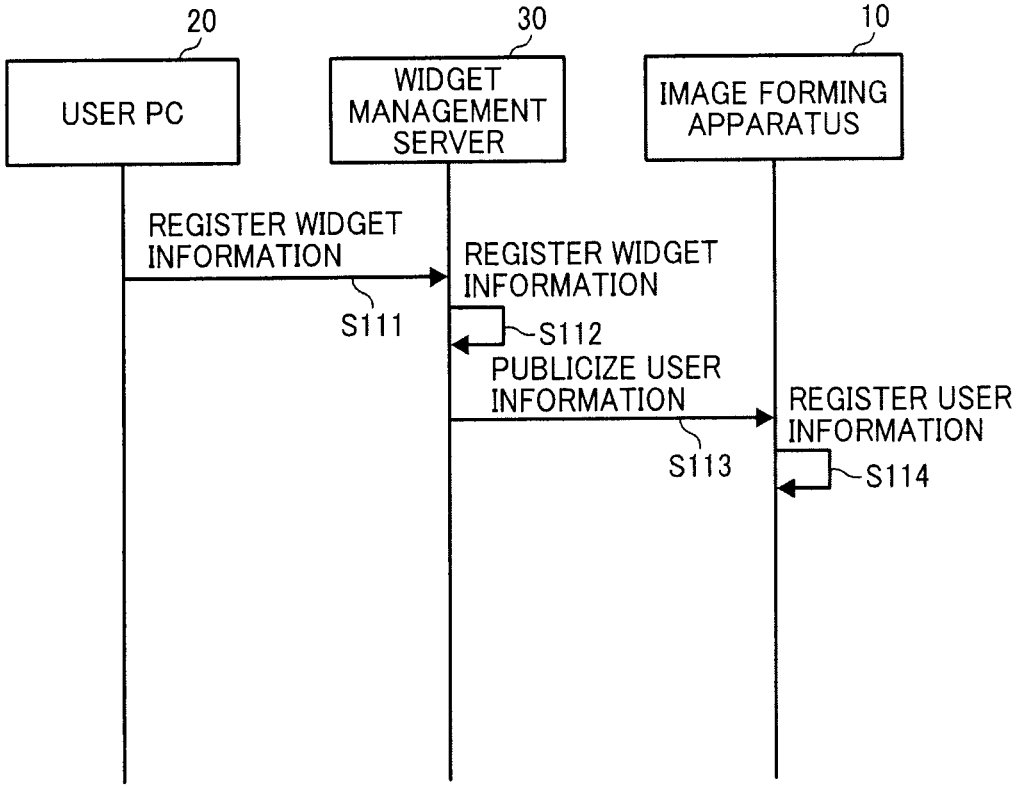
FIG. 5 is a sequence diagram for describing the process executed when sending the widget information of the monitoring devices widget 21.

FIG. 5 is a sequence diagram for describing the process executed when sending the widget information of the monitoring devices widget.

The application information sending unit 212 generates widget information of the monitoring devices widget 21 based on the instruction to activate the monitoring devices widget 21 of the user PC 20 by the user, and sends a request to register the generated widget information to the widget management server 30 (step S111). Each user PC 20 has information (IP address, host name, etc.) registered in advance, which is used for communicating with the widget management server 30.

Figures 6, 7, 8:
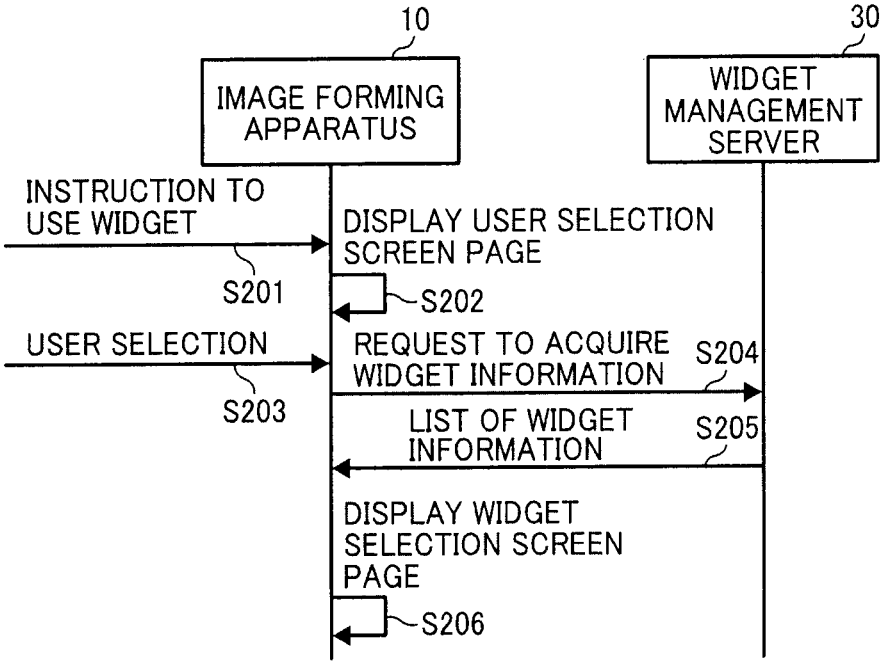
FIG. 6 illustrates an example of widget information of the monitoring devices widget 21.
FIG. 7 illustrates an example of the user management table 126.
FIG. 8 is a sequence diagram for describing the process of displaying a list of widgets that can be used by the user.

FIG. 6 illustrates an example of widget information of the monitoring devices widget 21. As shown in FIG. 6, the application information of the monitoring devices widget 21 includes a widget ID, a user ID, a coordination function identifier, a widget address, and a display name. Although not shown, there may also be print setting information, a file name, last access date, and print data.

The widget ID contains identification information for uniquely identifying each of the widgets. The user ID contains identification information of a user who is the owner of the monitoring devices widget 21. The coordination function identifier contains information for identifying a requested function included in the image forming apparatus 10 with which the widget is in coordination (that is to say, a function used by the widget). Examples of the coordination function identifier are "print" and "scan". "Print" indicates a print function. "Scan" indicates a scan function. The monitoring device widget 21 uses the print function of the image forming apparatus 10. Therefore, in the example shown in FIG. 6, "print" is indicated as the coordination function identifier. A widget address is identification information (such as a URL (Uniform Resource Locator)) for uniquely identifying each of the network applications in network communications. A display name is a character string for displaying the name of the network application. The widget ID, the user ID, the coordination function identifier, the widget address, and the display name are acquired from, for example, the attribute information management file 216.

In step S111, the widget information sent by the widget information sending unit 212 is received by the widget information registration unit 31 of the widget management server 30. The widget information registration unit 31 registers the widget information in the widget information management table 35 corresponding to the user ID included in the received widget information. When there is no widget information management table 35 corresponding to the user ID, the widget information registration unit 31 generates a widget information management table 35 that corresponds to the user ID, and registers the widget information in the generated widget information management table 35 (step S112).

When a new widget information management table 35 is generated (i.e., when widget information relevant to a user corresponding to the user ID included in the received widget information is registered for the first time), the publicizing unit 32 issues a publication in the network 40 (step S113). The publication includes the user ID included in the received widget information and a URL for acquiring the widget information (hereinafter, "widget information acquisition URL"). The widget information acquisition URL is a URL that is unique to each widget information management table 35. The widget information management table 35 is generated for each user. Consequently, the widget information acquisition URL is unique to each user.

Next, when the publication is received, the user detection unit 121 of the image forming apparatus 10 registers, in the user management table 126, the user ID and the widget information acquisition URL included in the publication (step S114).

FIG. 7 illustrates an example of the user management table 126. As shown in FIG. 7, the user management table 126 manages pairs of user IDs and URLs for acquiring widget information. The example shown in FIG. 7 includes records registered for user A and user B. The user management table 126 may be stored in the HDD 114.

After the processes executed in FIG. 5 are completed, the user may move to a place where the image forming apparatus 10 is installed, in order to operate the monitoring device widget 21. When plural image forming apparatuses 10 are connected to the network 40, the same publication is received by the respective user detection units 121 of the image forming apparatuses 10, and the user ID and the widget information acquisition URL are registered in the respective user management tables 126 of the image forming apparatuses 10. Therefore, the user can operate the widget from any of the image forming apparatuses 10. Similar processes in FIG. 5 are executed when the print widget 22 or scan widget 23 is activated. As a result, the widget information of the print widget 22 or the scan widget 23 is registered in the widget information management table 35.

Next, a description is given of a process executed as the user operates the image forming apparatus 10.

FIG. 8 is a sequence diagram for describing the process of displaying a list of widgets that can be used by the user.

When the user inputs an instruction to use a network application via the operations panel 15 (step S201), the UI control unit 122 of the image forming apparatus 10 causes the operations panel 15 to display a user selection screen page based on information registered in the user management table 126 (step S202).

FIG. 9 illustrates an example of a displayed user selection screen page. A user selection screen page 610 shown in FIG. 9 has a button displayed for each user. In FIG. 9, a button 611 corresponding to user A and a button 612 corresponding to user B are displayed.

Next, the user presses the button corresponding to his own user ID in the user selection screen page 610 (step S203). As the button is pressed, the widget information acquiring unit 123 acquires, from the user management table 126, a widget information acquisition URL that is associated with the user ID corresponding to the selected button. User authentication may be performed as the button corresponding to the user ID is pressed, and the succeeding processes may be executed only when the user authentication is successful.

Next, the widget information acquiring unit 123 sends a request to acquire widget information, to the widget information acquisition URL (step S204). The request for acquiring widget information is received by the widget information providing unit 33 of the network widget management server 30. The widget information providing unit 33 acquires widget information of all widgets registered in the widget information management table 35 corresponding to the widget information acquisition URL (i.e., the widget information management table 35 corresponding to the user operating the image forming apparatus 10), and sends a list of the acquired widget information to the image forming apparatus 10 (step S205). When sending the list of widget information items, the widget information providing unit 33 generates a URL that is unique to each of the widgets (each of the widget information items) for relaying communications between the image forming apparatus 10 and the widgets (hereinafter, "widget relay URL"). The widget information providing unit 33 adds the widget relay URL generated for each widget, to the widget information of the corresponding network application. Then, the application information providing unit 33 sends, to the image forming apparatus 10, a list of widget information items to which the URLs for relaying widgets have been added. Thus, each widget information item sent at step S205 may have one of the configurations illustrated in FIG. 10.

FIG. 10 illustrates a configuration of the widget information of the monitoring device widget 21 sent from the widget management server 30 to the image forming apparatus 10.

The widget information shown in FIG. 10 is formed by adding the widget relay URL to the widget information shown in FIG. 6, respectively. In step S205, the widget information providing unit 33 sends a list of widget information items, each widget information item having a configuration as shown in FIG. 10. The list of widget information items may include only one widget information item.

Next, the UI control unit 122 of the image forming apparatus 10 records the received list of widget information items in the RAM 112, and causes the operations panel 15 to display a screen page (widget selection screen page) including a list of widgets that can be used by the user, based on the list of widget information items (step S206).

FIG. 11 illustrates an example of a displayed widget selection screen page. A widget selection screen page 620 shown in FIG. 11 has buttons displayed for each widget. In FIG. 11, the widget selection screen page 620 is displaying a button 621 corresponding to the monitoring devices widget 21, a button 622 corresponding to the print widget 22, and a button 623 corresponding to the scan widget 23.

The process performed after the widget selection screen page 620 has been displayed may vary according to the type of the widget selected as an execution target. Therefore, descriptions are given for the case where the monitoring devices widget is selected according to the present embodiment.

Figure 12:
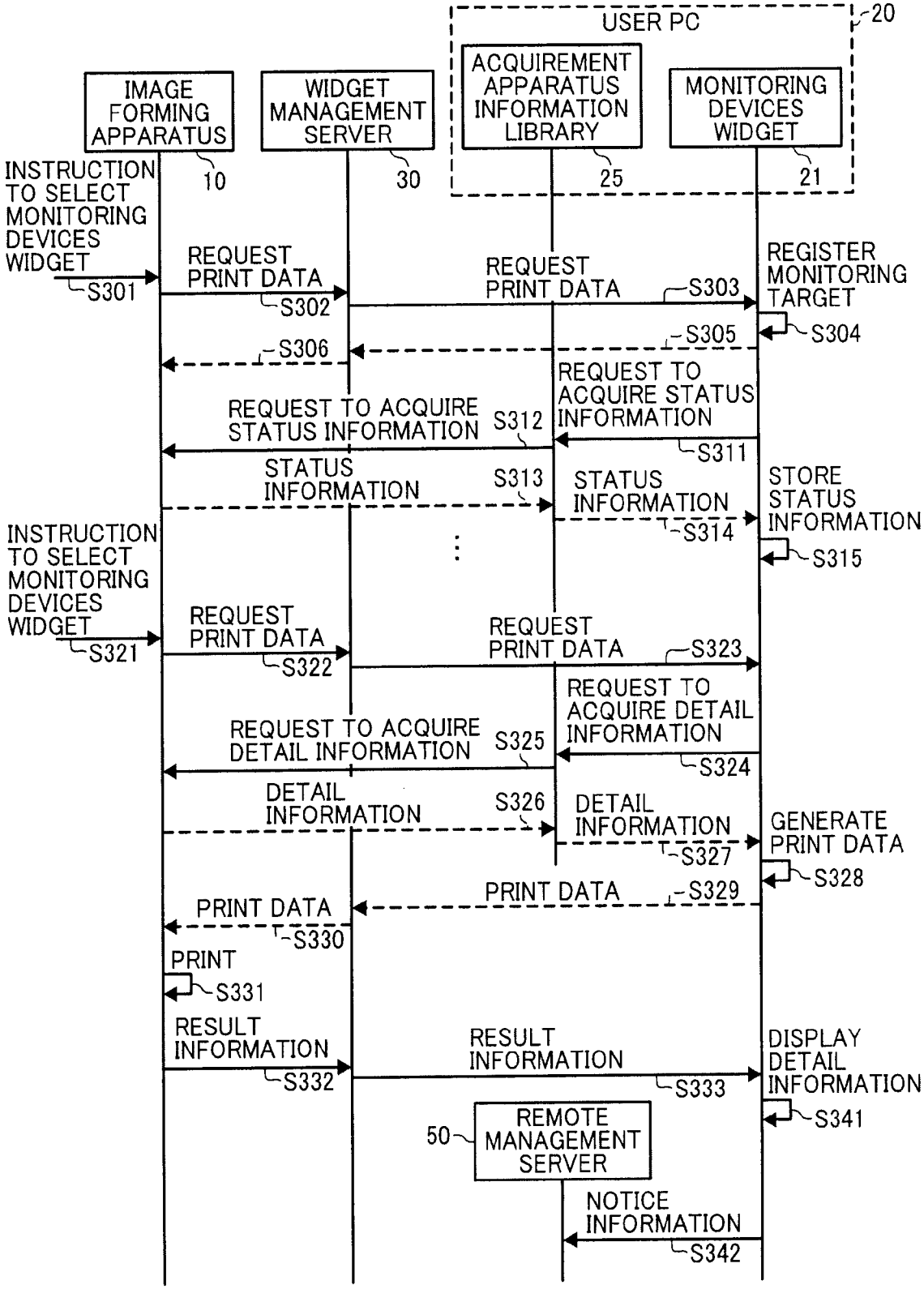
FIG. 12 is a sequence diagram for describing the process of the monitoring devices widget 21.

FIG. 12 is a sequence diagram for describing the process of the monitoring device widget 21.

In the widget selection screen page 620, if the image forming apparatus 10 is targeted for being a monitoring device, the user selects a button corresponding to the monitoring devices widget 21, and presses a start key in the operations panel 15 (step S301). Then, the widget coordination unit 124 recognizes that printing is to be executed, based on a coordination function identifier ("print") included in widget information corresponding to the pressed button (hereinafter, "current widget information"). In order to execute printing, it is necessary to obtain print data. Therefore, the widget coordination unit 124 sends a request to send print data ("print-data-send request") to the widget relay URL included in the current widget information (step S302). The print-data-send request includes the communication identifier of image forming apparatus (for example, "IP address").

The print-data-send request sent to the widget relay URL is received by the mediation unit 34 of the widget management server 30. The mediation unit 34 acquires widget information corresponding to the widget relay URL from the widget information management table 35, and transfers the print-data-send request to the widget address included in the widget information (step S303).

The print-data-send request sent to the widget address is received by the coordination unit 213 of the monitoring devices widget 21 in the user PC 20. The coordination unit 213 checks a monitoring target list for the IP address included the print-data-send request. The monitoring target list is a list using the secondary storage device 202 that stores IP addresses of the targeted image forming apparatuses 10 (the acquired status information). If the monitoring target list includes the IP address of the print-data-send request, the process from Step S328 is executed. In contrast, if the monitoring target list does not include the IP address of the print-data-send, the coordination unit 213 stores the IP address in the monitoring target list (S304).

In other words, the coordination unit 213 of the monitoring device widget considers the print-data-send request received at S303 to a request to register the target image forming apparatus 10. Therefore, the coordination unit 213 responds with a dummy response instead of the required print data. The mediation unit 34 transfers the dummy response data to the widget coordination unit 124 of the image forming apparatus 10 (step S306). For example, the dummy response is a response without substantive print data. The widget coordination unit 124 receives the dummy response. Instead of executing a print job, the widget coordination unit 124 finishes the process corresponding to the button 621.

In fact, the monitoring devices widget 21 monitors the target image forming apparatus 10 when the button 621 corresponding to the monitoring devices widget 21 shown in FIG. 11 is selected, instead of searching the target image forming apparatuses 10 connected the network 40 automatically. In other words, the user needs to operate the image forming apparatus 10 to select the button 621 corresponding to the monitoring devices widget 21.

The users can be checking the image forming apparatus 10 to determine whether each of image forming apparatuses 10 is targeted or not, because the users have to select the button 621 corresponding to the monitoring devices widget 21. As a result, it is possible for a user to willfully target an image forming apparatus 10 rather than it being selected automatically. Thus, users can clearly recognize not only an apparatus identifier like an apparatus name but also an installation position of the image forming apparatus 10.

When a monitoring target is included in the monitoring target list (in other words, when a first IP address is included in the monitoring target list), the monitoring unit 214 of the monitoring devices widget 21 begins to monitor the monitoring target. For example, the monitoring unit 214 calls a status information acquiring function and passes an IP address of the monitoring target list as an argument (S311). The status information acquiring function sends a request to acquire the status information to the status information providing unit 127 of the image forming apparatus 10 corresponding to the passed IP address (for example, a port number corresponding to the status information providing unit 127) (S312).

The status information providing unit 127 receives the request to acquire the status information, acquires the status information, and sends the status information acquired (S313). For example, the status information includes a name of the image forming apparatus 10 (the apparatus name), the amount of toner and paper remaining. The status information acquiring function of acquirement apparatus information library 25 outputs a response to acquire the status information to the monitoring unit 214 of the monitoring devices widget 21 (S314). The monitoring unit 214 stores the outputted status information associated with the IP address to the secondary storage device 202 (S315).

For example, the monitoring unit 214 periodically acquires the status information. If a plurality of IP addresses are included in the monitoring target list, the monitoring unit 214 acquires status information of each of the apparatuses corresponding to the plurality of IP addresses in series or in parallel, and stores the status information associated with each of the IP address (in other words, each of image forming apparatuses 10) to the secondary storage device 202.

The UI control unit 211 causes the display device 206 to display an image (icon) indicating that the widget is executing, after the monitoring device widget 20 begins to execute. The UI control unit 211 changes the image corresponding to a condition of the monitoring devices widget 21 or the status information of the target image forming apparatus 10 such as the images shown in FIG. 13.

Figure 13:
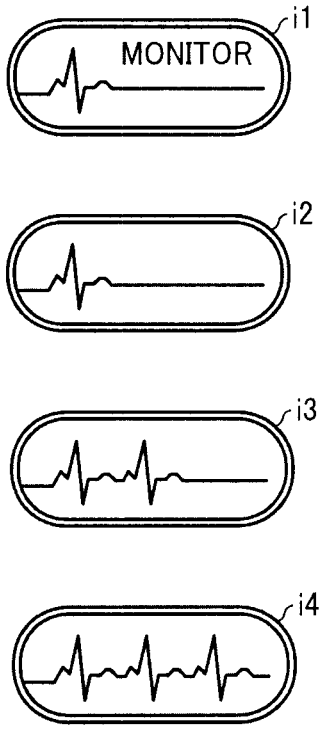
FIG. 13 illustrates an example of a variation in displayed icon of the monitoring devices widget 21.

FIG. 13 illustrates an example of a variation in a displayed icon of the monitoring devices widget 21. An icon i1 shown in FIG. 13 indicates that there is no monitoring target. In other words, if the monitoring target list does not include an IP address, the UI control unit 211 causes the display device 206 to indicate an icon i1. An icon i2 indicates that the target image forming apparatus is in a normal or good condition. In other words, if the acquired status information includes no warning and no error, the UI control unit 211 causes the display device 206 to indicate an icon i2. An icon i3 indicates that the target image forming apparatus is in a warning condition such as a condition of warming-up, sleeping, processing, having a low amount of toner, having a low amount of paper remaining and so on. In other words, if the acquired status information includes these warnings, the UI control unit 211 causes the display device 206 to indicate an icon i3. An icon i4 indicates that the target image forming apparatus is in an error condition such as a paper jam, having no amount of toner, having an opened cover, providing no response to acquire the status information and so on. In other words, if the acquired status information includes these errors, the UI control unit 211 causes the display device 206 to indicate an icon i4.

Each of the icons is drawn as a waveform signal. A period of the waveform signal indicates a degree of condition from the normal condition. Therefore, the users can roughly figure out a condition of the image forming apparatus 10 by checking the waveform signal. In addition, a color of the waveform signal is changed corresponding to the period of the waveform signal. For example, the waveform signal of icon it and icon i2 is blue or green; the waveform signal of icon i3 is yellow; the waveform signal of icon i4 is red. Therefore, the users may easily figure out a condition of the image forming apparatus 10.

The icon may be displayed corresponding to each of the target image apparatuses separately, or corresponding to the target image apparatuses in total. In the latter case, if one of the target image apparatuses is in a condition corresponding to the icon i3 or the icon i4, the icon i3 or the icon i4 is displayed.

If the icon is selected (for example, by a user double-clicking the icon), the UI control unit 211 causes the display device 206 to display a status screen page which indicates the target image forming apparatus 10.

Figure 14:
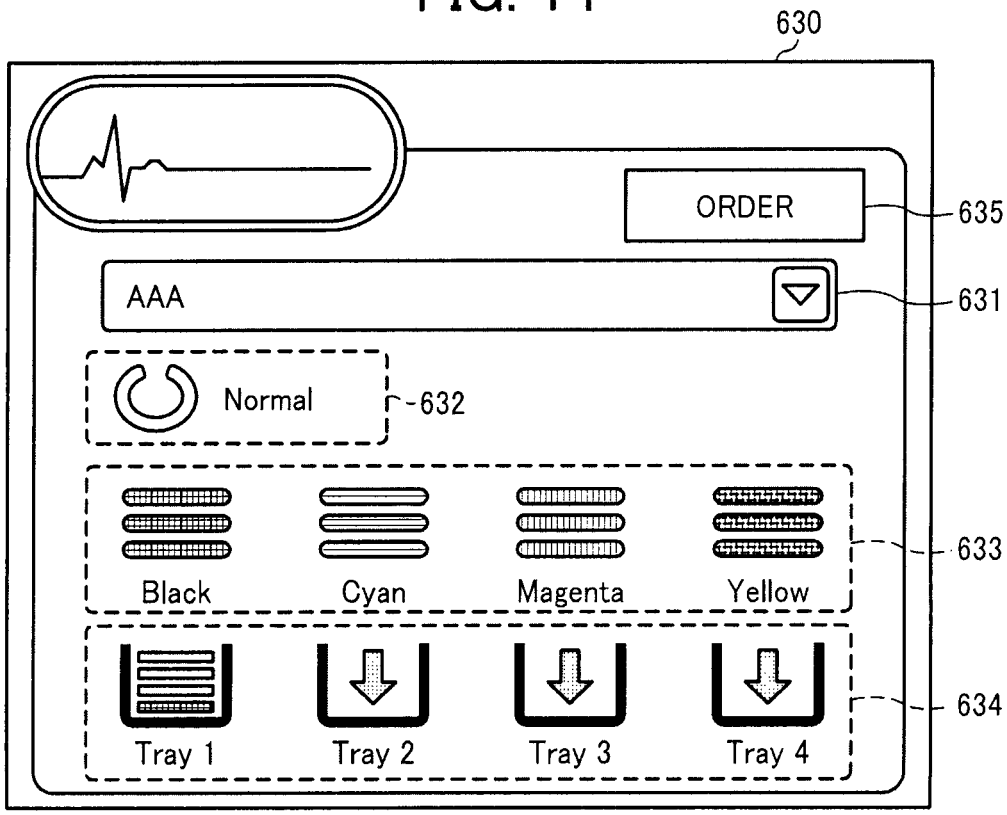
FIG. 14 illustrates an example of the status screen page.

FIG. 14 illustrates an example of the status screen page. A selection screen page 630 shown in FIG. 14 has a list-box 631, a status display area 632, an amount of toner area 633, a paper remaining area 634, and an order button 635.

The list-box 631 displays a list of the target image forming apparatuses 10, for selecting one of the target image forming apparatuses 10 to display the status information. The UI control unit 211 indicates the status display area 632, the amount of toner area 633, and the paper remaining area 634 corresponding to the status information of the image forming apparatus selected at the list-box 631. The image forming apparatus selected at the list-box 631 may be targeted to be monitored (i.e., to acquire the status information of that image forming apparatus).

The status display area 632 indicates a symbol corresponding to the condition of the image forming apparatus 10 such as the normal condition, the warning condition, and the error condition. The amount of toner area 633 indicates the amount of toner corresponding to each toner color. The amount of toner area 633 shown in FIG. 14 indicates that there is enough toner. The paper remaining area 634 indicates an amount of paper remaining corresponding to each of the paper feed trays. The paper remaining area 634 shown in the example of FIG. 14 indicates that a paper feed tray 1 has some paper remaining, and paper feed trays 2, 3, 4 have no remaining paper.

The order button 635 is a button to order consumables such as a bottle of toner or a set of paper if the amount of toner or the paper remaining is not enough. Therefore, if the order button 635 is selected, the notice information transportation unit 215 transports the target status information to the remote management server 50. The remote management server 50 sends a request to order a bottle of toner or a set of paper if the remote management server 50 recognizes that the amount of toner or the paper remaining is not enough from the target status information.

In contrast, if the users allow the notice information to be sent to the remote management server 50, the users select the monitoring devices widget in the widget selection screen page 620, press the start key in the operations panel 15 (S321). In other words, selecting the monitoring devices widget in the widget selection screen page 620 of the target image forming apparatus 10 corresponds to the user's own will to allow the notice information to be sent. As described earlier, selecting the monitoring devices widget in the widget selection screen page 620 of the target image forming apparatus 10 corresponds to targeting the image forming apparatus.

Next, processes of steps S322 and S323 are described which correspond to processes of steps S302 and S303 as described earlier. The print-data-send request sent to the widget address is received by the coordination unit 213 of the monitoring devices widget 21 in the user PC 20. The coordination unit 213 checks a monitoring target list for the IP address included in the print-data-send request. This time the monitoring target list includes the IP address of the print-data-send request.

Therefore the coordination unit 213 causes the notice information transportation unit 215 to send the notice information with the IP address to the remote management server 50.

The notice information transportation unit 215 calls a detail information acquiring function passes an IP address as an argument (S324). The detail information acquiring function sends a request to acquire the detail information to the detail information providing unit 128 of the image forming apparatus 10 corresponding to the passed IP address (for example, a port number corresponding to the detail information providing unit 128) (S325).

The detail information providing unit 128 receives the request to acquire the detail information, acquires the detail information, and sends the detail information acquired (S313). The detail information acquiring function of acquirement apparatus information library 25 outputs a response to acquire the detail information to the monitoring unit 214 of the monitoring devices widget 21 (S327).

Next, the notice information transportation unit 215 generates print data for printing the detail information (S328). For example, using a printer driver to generate PDL (Page Description Language). However, the detail information may be transformed into a general-purpose data format such as TIFF (Tagged Image File Format) or PDF (Portable Document Format) if the image forming apparatus 10 can receive the general-purpose data format as the print data to print.

Next, the coordination unit 213 returns the generated print data to the mediation unit 34 of the widget management server 30 as a response to the print-data-send request (step S328). The print data corresponds to a request to print the detail information. Next, the mediation unit 34 transfers the print data to the widget coordination unit 124 of the image forming apparatus 10 (step S330).

The widget coordination unit 124 inputs the received print data to the job execution control unit 125. Next, the job execution control unit 125 executes a print job associated with the print data. As a result, the generated print image of the detail information is outputted by the printer 13 onto a printed sheet (step S214). From the user point of view, it appears that the image forming apparatus simply prints the printed sheet, in response to a selection of the button 621 corresponding to the monitoring devices widget 21 and a press of the start key in the operations panel 15. The users may confirm information sent to the remote management server 50 on the printed sheet.

The widget coordination unit 124 sends a result to print the print job (information of success or failure) to the widget relay URL included in the current widget information, after the print job is finished executing (S332). The mediation unit 34 of the widget management server 30 receives the result sent to the widget relay URL. The mediation unit 34 acquires widget information corresponding to the widget relay URL from the widget information management table 35, and transfers the result to the widget address included in the widget information (step S303).

The result sent to the widget address is received by the coordination unit 213 of the monitoring devices widget 21 in the user PC 20. The coordination unit 213 inputs the result to the notice information transportation unit 215. The notice information transportation unit 215 causes the display device 206 to display a confirm detail information screen page (S341). However, the confirm detail information screen page is displayed in response to a selected icon, for example a selected item in a menu of the monitoring devices widget 21.

Figure 15:
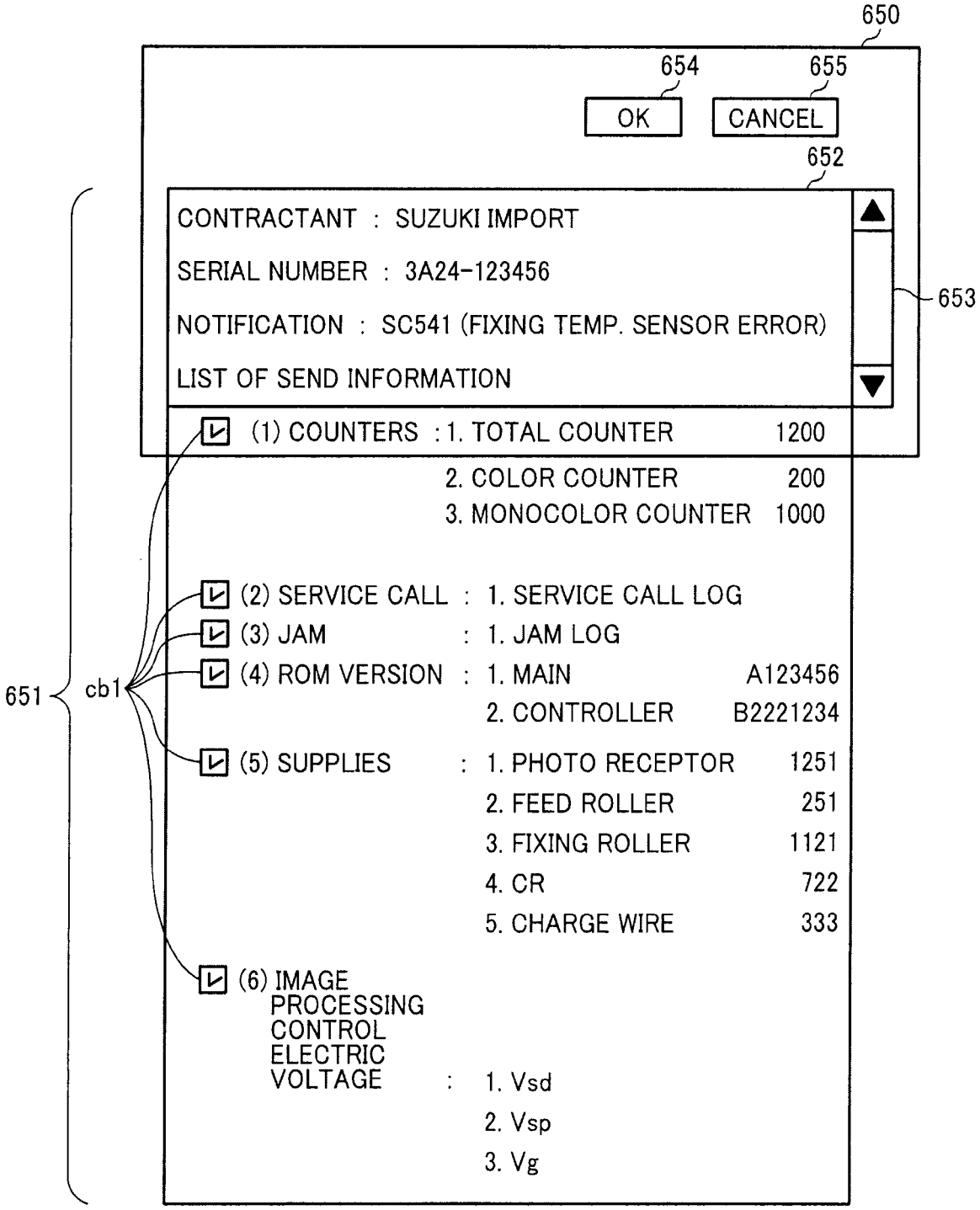
FIG. 15 illustrates an example of the confirm detail information screen page.

FIG. 15 illustrates an example of the confirm detail information screen page. A confirm detail information screen page 650 shown in FIG. 15 has a detail information display area 651, a window 652, a scroll bar 653, an OK-button 654, and a cancel-button 655.

The detail information display area 651 displays separate detail information from the image forming apparatus 10, and constructs a check-button cb1 corresponding to each of the detail information. The notice information includes an item checked with the check-button cb1 (an item selected). The notice information excludes an item not checked with the check-button cb1 (an item not selected). In other words, the notice information can be edited in the confirm detail information screen page 650. Therefore, the user may willfully restrict the notice information sent to outbound areas. If an item has a hierarchy, the check-button cb1 is constructed to correspond to low-level items. For example, "(4) ROM VERSION" has low-level items such as "(1) MAIN" and "(2) CONTROLLER". In this case, the check-button cb1 is constructed to correspond to each of "(1) MAIN" and "(2) CONTROLLER". Practical detail information can be constructed for over 1000 items. For simplification, only a part of the possible detail information is displayed in FIG. 15.

It may be a troublesome task to select a check-button cb1 corresponding to large number of the detail information whenever the notice information is sent. Therefore, the notice information transportation unit 215 stores check-buttons cb1 corresponding to each of the items of detail information to the attribute information management file 216. When the confirm detail information screen page 650 is displayed next time, the notice information transportation unit 215 sets an attribute to each check-button cb1 corresponding to the attribute information management file 216. For example, the UI control unit 211 may display each of items of the detail information with the check-button, and may store an attribute to each check-button cb1 to the attribute information management file 216.

The window 652 displays a part of the detail information display area 651 targeted. The scroll bar 653 selects a target to display a part of the detail information display area 651. The cancel-button 655 accepts a request to cancel the transport of the notice information.

The OK-button 654 accepts a request to transport the notice information. In other words, if the OK-button is selected, the notice information transportation unit 215 acquires the detail information corresponding to each of the check-buttons cb1 selected, and sends the notice information corresponding to the detail information acquired (S342). For example, sending the notice information may use a communication protocol which is a specific protocol of the remote management server 50 or a general-purpose protocol such as e-mail or FTP (File Transfer Protocol).

The remote management server 50 recognizes a process to automatically execute depending on the target status information. For example, if the notice information indicates an abnormal status, information about the abnormal status is sent to a computer of the call center. In the call center, an operator calls the user to figure out a condition depending on the information. As necessary, a trained service person is assigned. Therefore, the notice information corresponds to a request to maintain the image forming apparatus 10.

As described above, according to the present embodiment, the status information or the detail information are sent to the remote management server 50 corresponding to the user's own will.

Furthermore, the user PC 20 sends the status information or the detail information to the remote management server 50. Therefore, the image forming apparatus does not need to connect to a global network. The user may use a convenient communication protocol like e-mail for the user environment 1.

Additionally, a user may abbreviate a printing operation of the detail information or an operation of displaying the detail information.

The claimed invention is not limited directly to the above described embodiments. It should be understood by those skilled in the art that various modifications, combinations, sub-combinations and alterations may occur depending on design requirements and other factors insofar as they are within the scope of the appended claims or the equivalents thereof.

What is claimed is:

1. A monitoring device system comprising:

a user apparatus including a monitoring device application; and more than one image forming apparatus, wherein the user apparatus includes an application information sending unit configured to send application information corresponding to the monitoring device application for registering any one of the image forming apparatus as a monitored target device, the application information including identification information of the monitoring device application in the user apparatus;

a registering unit configured to register the image forming apparatus as the monitored target device in response to receiving a request information sent based on the identification information; and a notice information control unit configured to acquire information about the image forming apparatus registered as the monitored target device, wherein the image forming apparatus includes a display unit configured to display an application list screen including an application information item corresponding to the application information sent by the application information sending unit at the user apparatus, a request information sending unit configured to send the request information to register the image forming apparatus as the monitored target device at the user apparatus corresponding to the application information item, and a communication control unit, at the image forming apparatus registered as the monitored target device, configured to send the information about the image forming apparatus to the user apparatus which has registered the image forming apparatus as the monitored target device by the registering unit.

2. The monitoring device system according to claim 1, wherein the monitoring device application is configured to monitor the image forming apparatus registered as the monitored target device and to display the information about the image forming apparatus registered as the monitored target device at a display unit on the user apparatus.

3. The monitoring device system according to claim 2, wherein the user apparatus is configured to display an option for ordering at least one consumable item used at the image forming apparatus registered as the monitored target device or to request maintenance service for the image forming apparatus registered as the monitored target device.

4. The monitoring device system according to claim 1, wherein the notice information control unit is configured to send print data for printing the information about the image forming apparatus registered as the monitored target device to the image forming apparatus;

the image forming apparatus is configured to receive the print data and to print the information about the image forming apparatus registered as the monitored target device.

5. The monitoring device system according to claim 1, further comprising:

a remote management server connected to the user apparatus via a network, wherein the notice information control unit is configured to send a notice information including a user selecting an information item of the information about the image forming apparatus registered as the monitored target device to the remote management server in response to a send input received at the user apparatus.

6. The monitoring device system according to claim 1, wherein the monitoring device application is configured to receive a status information of the image forming apparatus as the information about the image forming apparatus registered as the monitored target device and receive detail information as the information about the image forming apparatus registered as the monitored target device upon a user request received from the image forming apparatus.

7. A monitoring method, implemented on a monitoring device system that comprises a user apparatus including a monitoring device application and more than one image forming apparatus, the method comprising:

at the user apparatus, sending application information corresponding to the monitoring device application for registering any one of the image forming apparatus as a monitored target device, the application information including identification information of the monitoring device application in the user apparatus;

at the user apparatus, registering the image forming apparatus as the monitored target device in response to receive a request information sent based on the identification information;

at the user apparatus, acquiring information about the image forming apparatus registered as the monitored target device;

at the image forming apparatus, displaying an application list screen including an application information item corresponding to the application information sent by the application information sending unit at the user apparatus;

at the image forming apparatus, sending the request information to register the image forming apparatus as the monitored target device at the user apparatus corresponding to the application information item; and at the image forming apparatus, sending the information about the image forming apparatus to the user apparatus which has registered the image forming apparatus as the monitored target device by the registering unit.

* * * * *